US007708207B2

(12) United States Patent
Grace et al.

(10) Patent No.: US 7,708,207 B2
(45) Date of Patent: May 4, 2010

(54) WASH LIQUID SPRAY NOZZLES FOR PULP MAT AND METHOD TO ASSEMBLE NOZZLE

(75) Inventors: Todd S. Grace, Alpharetta, GA (US); David Hollis Gordy, Monroe, LA (US); David Brin Tidwell, Monroe, LA (US)

(73) Assignee: Andritz Inc., Glens Falls, NY (US)

( * ) Notice: Subject to any disclaimer, the term of this patent is extended or adjusted under 35 U.S.C. 154(b) by 302 days.

(21) Appl. No.: 11/469,968

(22) Filed: Sep. 5, 2006

(65) Prior Publication Data

US 2007/0163630 A1 Jul. 19, 2007

Related U.S. Application Data

(60) Provisional application No. 60/743,140, filed on Jan. 18, 2006.

(51) Int. Cl.
*B05B 17/00* (2006.01)
*B05B 1/14* (2006.01)

(52) U.S. Cl. ..... 239/1; 239/550

(58) Field of Classification Search ..... 239/1, 239/566, 550, 553.5, 556, 548; 411/537
See application file for complete search history.

(56) References Cited

U.S. PATENT DOCUMENTS 596,941 A 1/1898 Millspaugh
1,163,734 A 12/1915 Binns
1,396,092 A 11/1921 Binns
1,565,380 A * 12/1925 March ..... 210/494.1
2,166,300 A * 7/1939 Komar ..... 29/890.143
2,204,802 A * 6/1940 Gessler ..... 34/309
2,767,020 A 10/1956 Knowles
2,987,262 A * 6/1961 Goyette et al. ..... 239/550
2,998,934 A * 9/1961 Broughton ..... 239/521
3,001,722 A 9/1961 Lawlor et al.
3,059,861 A * 10/1962 Umbricht et al. ..... 239/518
3,080,124 A * 3/1963 Rathmann ..... 239/450
3,150,082 A * 9/1964 Rich ..... 210/395
3,351,291 A 11/1967 Pohle
3,363,774 A * 1/1968 Luthi ..... 210/404
3,369,760 A 2/1968 Schaible
3,454,970 A * 7/1969 Sutherland ..... 8/156
3,811,621 A * 5/1974 Augustine ..... 239/520
3,859,213 A 1/1975 Hunt
3,878,698 A 4/1975 Friksson et al.
3,966,544 A * 6/1976 Johnson ..... 162/199
4,058,262 A * 11/1977 Burnham ..... 239/545
4,121,968 A 10/1978 Wells
4,152,202 A 5/1979 DeLigt (Continued)

FOREIGN PATENT DOCUMENTS

CH 167073 4/1934

*Primary Examiner*—Davis Hwu
(74) *Attorney, Agent, or Firm*—Nixon & Vanderhye P.C.

(57) ABSTRACT

A nozzle assembly for spraying a wash liquid towards a pulp mat, the assembly including an integral fastener-nozzle having a conduit for the wash liquid, an outlet to the conduit for discharging the wash liquid and an attachment to secure the fastener-nozzle to an aperture in a wash liquid pipe, and a wash liquid direction device extending outwardly from the pipe and adapted to direct the wash liquid from the outlet towards the pulp mat.

16 Claims, 4 Drawing Sheets

U.S. PATENT DOCUMENTS 4,217,170 A 8/1980 Luthi
4,236,999 A 12/1980 Burgess et al.
4,248,716 A * 2/1981 LaValley ..... 210/402
4,266,413 A * 5/1981 Yli-Vakkuri ..... 68/158
4,276,169 A * 6/1981 Browne et al. ..... 210/404
4,370,231 A * 1/1983 LaValley ..... 210/404
4,388,921 A * 6/1983 Sutter et al. ..... 606/71
4,511,088 A * 4/1985 Wilt et al. ..... 239/455
4,522,716 A * 6/1985 LaValley ..... 210/210
4,670,099 A * 6/1987 LaValley ..... 162/60
4,697,292 A * 10/1987 LaValley ..... 8/156
4,711,259 A * 12/1987 Martin et al. ..... 134/166 R
4,737,100 A * 4/1988 Schnell et al. ..... 431/3
4,738,401 A * 4/1988 Filicicchia ..... 239/600
4,795,558 A * 1/1989 LaValley ..... 210/217
4,951,879 A * 8/1990 Fay et al. ..... 239/553.5
5,028,007 A * 7/1991 Wokal ..... 239/518
5,154,356 A * 10/1992 Sorenson ..... 239/550
5,232,156 A * 8/1993 Csordas et al. ..... 239/117
5,564,448 A * 10/1996 Lincoln ..... 134/166 R
5,965,017 A 10/1999 Nelson et al.
6,892,969 B2 * 5/2005 Dolan et al. ..... 239/566
2002/0179745 A1 * 12/2002 Dolan et al. ..... 239/566

* cited by examiner

WASH LIQUID SPRAY NOZZLES FOR PULP MAT AND METHOD TO ASSEMBLE NOZZLE

This application claims the benefit of and claims priority to Application Ser. No. 60/743,140 filed on Jan. 18, 2006 and is incorporated herein by reference.

BACKGROUND

The present invention relates to nozzles for a shower pipe to spray wash liquid onto a pulp mat.

Pulp is typically processed in mills by soaking or mixing wood pieces in tanks with chemicals that convert the wood pieces into pulp, and then bleaching pulp. The processing typically involves repeated stages of mixing the pulp with liquid and drawing the liquid out of the pulp by allowing the pulp to form mats on cylindrical vacuum drums. The pulp mats are washed by spraying wash liquid onto the mats. The wash liquid cleans chemicals out of the pulp mat. The wash liquid is sprayed from nozzles attached to liquid pipes spanning the width of the vacuum drums. There is a long felt need for liquid pipes and nozzle assemblies that uniformly spray wash liquid onto the mat and are inexpensive to manufacture and operate.

SUMMARY

A shower pipe and nozzle assembly for spraying a wash liquid on a pulp including: apertures in the pipe extending a length of the pipe spanning a width of the pulp mat, are laterally aligned along two or more rows such that adjacent apertures are in different rows, and the nozzle assembly includes a nozzle, a mounting block and a lip wherein the nozzle includes a hollow stem that attaches to the aperture and secures the nozzle assembly to the pipe, the block has a face that conforms to the pipe surface surrounding the aperture, an opposite face supporting the lip and an opening for the nozzle stem which is offset from a center of the block, and the lip includes a curved fan for turning wash liquid from the nozzle towards the pulp mat, a mounting surface abutting the opposite face of the block and a corner fitting over an edge of the block. The wash liquid flows through the pipe, the hollow stem of the nozzle and out of the nozzle as a stream that is generally tangential to the lip. The fan of the lip gradually turns the water towards the pulp mat and spreads the stream such that the water is sprayed uniformly on the mat. The multiple rows of apertures and nozzles project wash liquid towards the mat at different directions.

A nozzle assembly for spraying a wash liquid onto a pulp mat, the assembly comprising: a fastener-nozzle having an internal conduit for the wash liquid, an external fastener structure for attaching to an aperture in a wash liquid pipe and an outlet to the internal conduit for discharging the wash liquid, and a curved lip having a curved surface mounted to the pipe by the fastener-nozzle extending from the outlet to the internal conduct, the curved surface having an expanding width to convert a stream of wash liquid from the outlet to a sheet of wash liquid directed to the mat. A mounting block may be included in the assembly between the pipe and lip, wherein the block has an offset opening to receive the fastener-nozzle.

DETAILED DESCRIPTION

Figure 1:
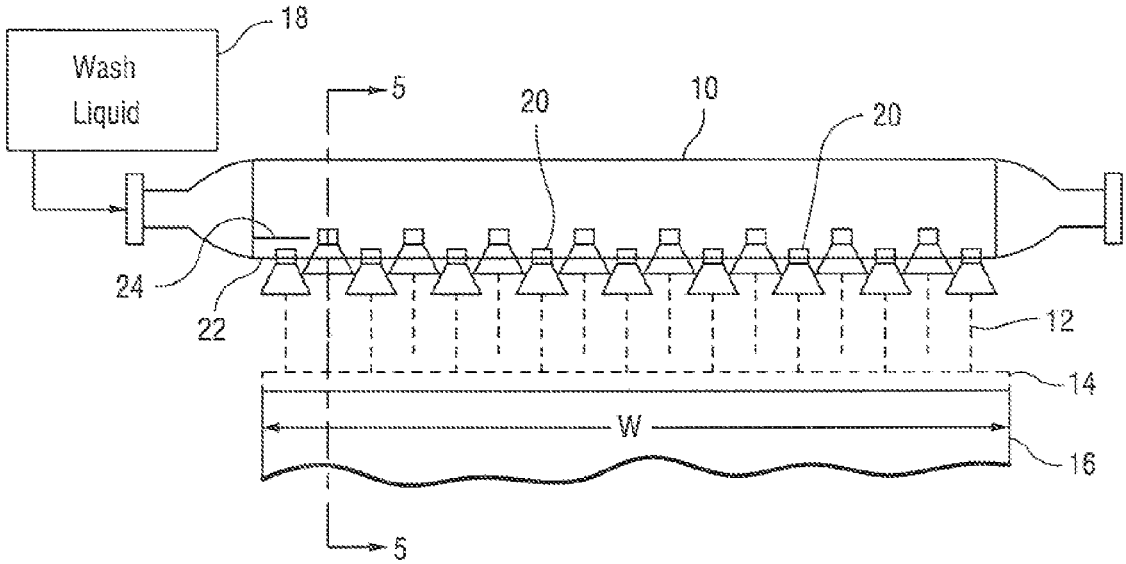
FIG. 1 is a side view of a shower pipe and nozzle assembly, and a section of a pulp mat on a cylindrical dryer.

FIG. 1 shows a shower pipe 10 that sprays a wash liquid 12 onto a pulp mat 14. The mat (shown by dotted lines) forms on a rotating cylindrical vacuum drum 16. The liquid wash is sprayed evenly and uniformly on the mat in one, two or more wash liquid sheets. The shower pipe 10 is positioned near the surface of the mat 14 and drum 16. The shower pipe may be an extended cylinder spanning the width (W) of the vacuum drum. The pipe may be circular in cross-section, but may be rectangular, curvilinear or have some other cross-sectional shape. The pipe is preferably hollow and has an interior closed conduit 26 through which flows the wash liquid. A source 18 of liquid wash is connected to one or both ends of the pipe.

Wash liquid nozzle assemblies 20 are arranged along the length of the pipe 10. The nozzle assemblies may be aligned in one, two or more rows extending laterally along the pipe. In the embodiment shown in FIG. 1, the nozzle assemblies are arranged along a first row 22 and a second row 24. The rows may be angularly offset by an angle (A in FIG. 5) that may be in a range of 3 degrees to 20 degrees. The nozzle assemblies 20 may be arranged to alternate between the rows along the length of the pipe. The nozzle assemblies may be equally spaced along the pipe and the spacing may be determined to provide a relatively uniform spray of wash liquid on the pulp mat 14. The dotted lines in FIG. 1 between the nozzle assemblies and the mat 14 indicate a uniform flow of two sheets of wash liquid being sprayed onto the mat. Preferably, the sprays from two adjacent nozzle assemblies on the same row (and separated by at least one other nozzle assembly on another row) do not overlap.

Figure 2:
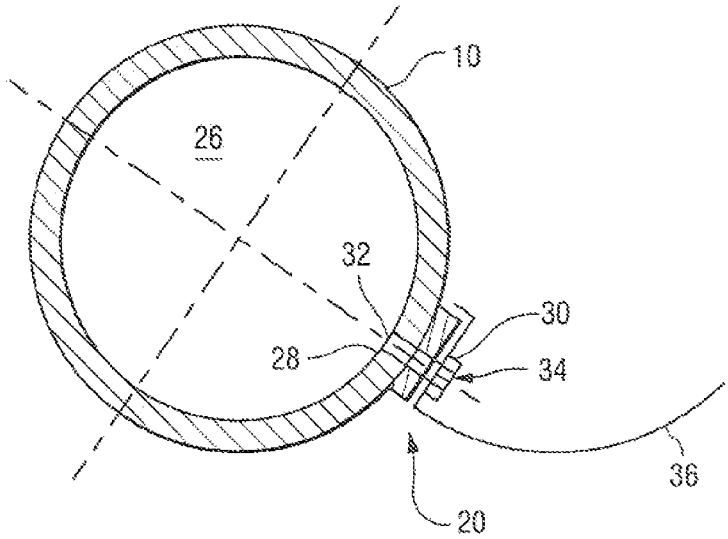
FIG. 2 is a cross-sectional view of the shower pipe and nozzle assembly, showing just one nozzle assembly.

FIG. 2 is a cross-sectional view of the pipe 10 and a single nozzle assembly 20. The interior surface of the pipe defines a wash liquid passage 26. Along each row in the pipe are a series of equally spaced apertures 28 that receive a nozzle-fastener 30 of the nozzle assembly. The apertures 28 may be threaded to receive a threaded stem portion of the nozzle fastener. The apertures 28 may be tapered to ease insertion of the fastener. Wash liquid flows through a hollow passage 32 of the stem of the nozzle-fastener. This hollow passage has an inlet open to the liquid passage 26 and an outlet 34 for projecting wash liquid relatively tangentially to a lip 36 of the nozzle assembly. The nozzle-fastener also secures the nozzle assembly to the pipe, and extends through openings in the lip 36 and in the mounting block 46 (FIG. 4).

Figure 3:
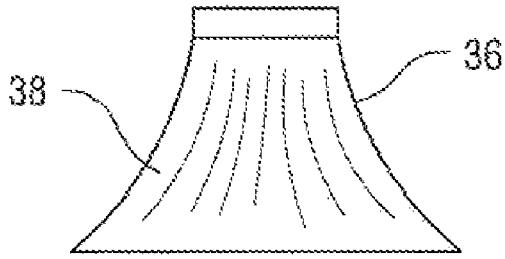
FIG. 3 is a top view of the lip of the nozzle assembly.

As show in FIG. 3, the lip 36 may have a curved surface 38 that has a radially inward section (near the pipe) that is relatively tangent to the circumference of the pipe and perpendicular to the stream of wash liquid flowing from the nozzle. The lip includes a radially outward portion that both curves into the wash liquid stream and expands laterally. The lip may be a generally thin metal or plastic plate having a curved surface 38, a mounting section 48 and a corner 50. The mounting section 48 is a flat planar section that abuts an outside face 51 of the mounting block 46. The corner 50 is a right angled lip that fits over an outside edge 52 of the mounting block. In top view (FIG. 3), the curved surface of the lip is relatively narrow near the nozzle outlet 34 and expands into a fan-like shape. The curved surface 38 of the lip causes the water stream to spread out into a fan shaped liquid spray that flows to the pulp mat.

Figure 4:
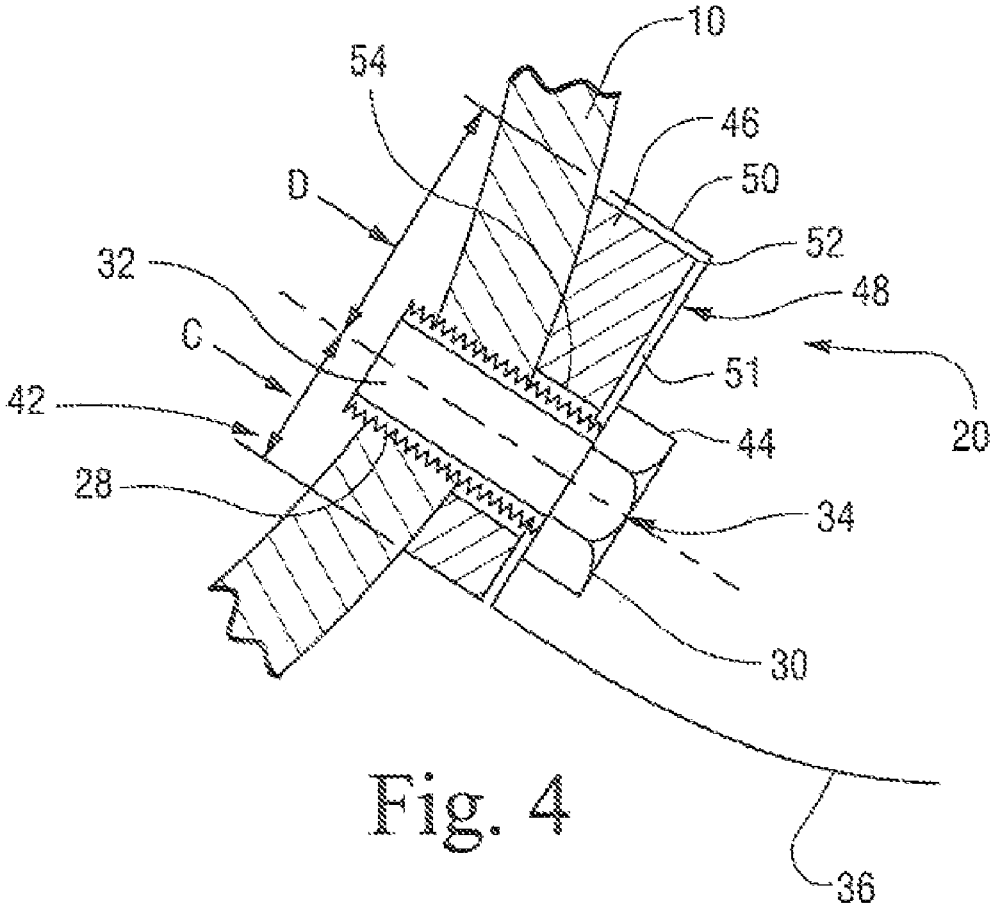
FIG. 4 is an enlarged cross-sectional view of the nozzle assembly showing the hollow nozzle stem attached to an aperture in the pipe, a mounting block for the nozzle assembly, and a portion of the lip of the nozzle assembly.

FIG. 4 is an enlarged view of a nozzle assembly 20 attached to the pipe 10. The nozzle-fastener 30 includes a threaded stem 42 that screws into a threaded aperture 28 in the pipe. The head 44 of the nozzle-fastener may be a hexed bolt head. In one embodiment, the nozzle-fastener is a bolt having a hollow passage 32 that provides a wash fluid conduit from the liquid passage 26 in the pipe to the nozzle outlet 34. The nozzle-fastener secures the nozzle assembly to the pipe.

The nozzle assembly may also include a mounting block 46 that is generally rectangular and has a first side that conforms to and abuts an outer surface of the pipe. The mounting block includes a second side, opposite to the first side, that is generally planar and provides a support surface for a planar mounting section 48 of the lip. An opening 54 through the mounting block receives the stem of the nozzle-fastener, but may not be threaded. The opening 54 in the block may be offset (see difference of lines D and C) from a center of the block. The offset allows the outlet 34 of the fastener-nozzle to be in close proximity to the radially inward portion of the curved surface 38 of the lip 36. The second side of the mounting block abuts against the planar mounting section 48 of the lip 36, when the nozzle-fastener secures the assembly 20 to the pipe. The corner 50 of the lip is a narrow strip that forms a 90-degree corner with respect to the mounting section 48 of the lip. When fitted to the mounting block, the corner 50 folds over an edge 52 of the mounting block and thereby assists preventing the lip from rotating about the mounting block and nozzle-fastener.

Figure 5:
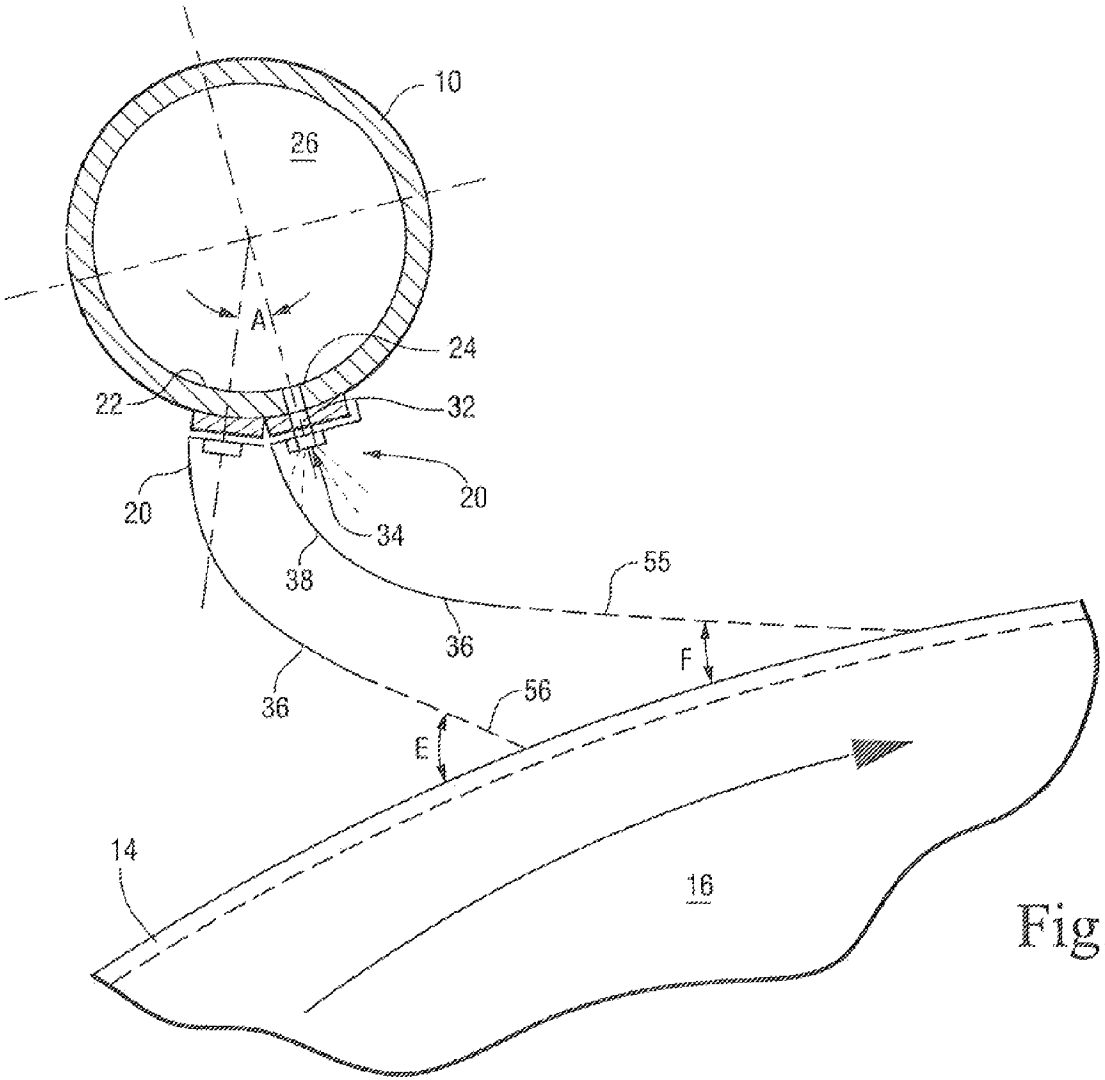
FIG. 5 is a cross-sectional view of the shower pipe and nozzle assembly taken along line 5-5 in FIG. 1 and showing a side view of a portion of the pulp mat and cylindrical dryer.

FIG. 5 shows wash liquid jetting from the outlet 34 of the passage 32 through the nozzle-fastener and flowing onto the curved surface 38 of the lip 36. The lip spreads the water stream and turns the water stream towards a tangent of the pulp mat 14 and cylindrical drum 16. Preferably, the spray of wash liquid from each row 22, 24 of nozzle assemblies is a generally uniform across the width of the mat. The angle (E, F) between the wash spray and mat depends on the row of the nozzle assembly and the amount of curvature in the lip. In the embodiment shown in FIG. 5, two sheets of wash liquid 55, 56 flow onto the pulp mat, where each sheet is from one of the two rows of nozzle assemblies.

Figure 6:
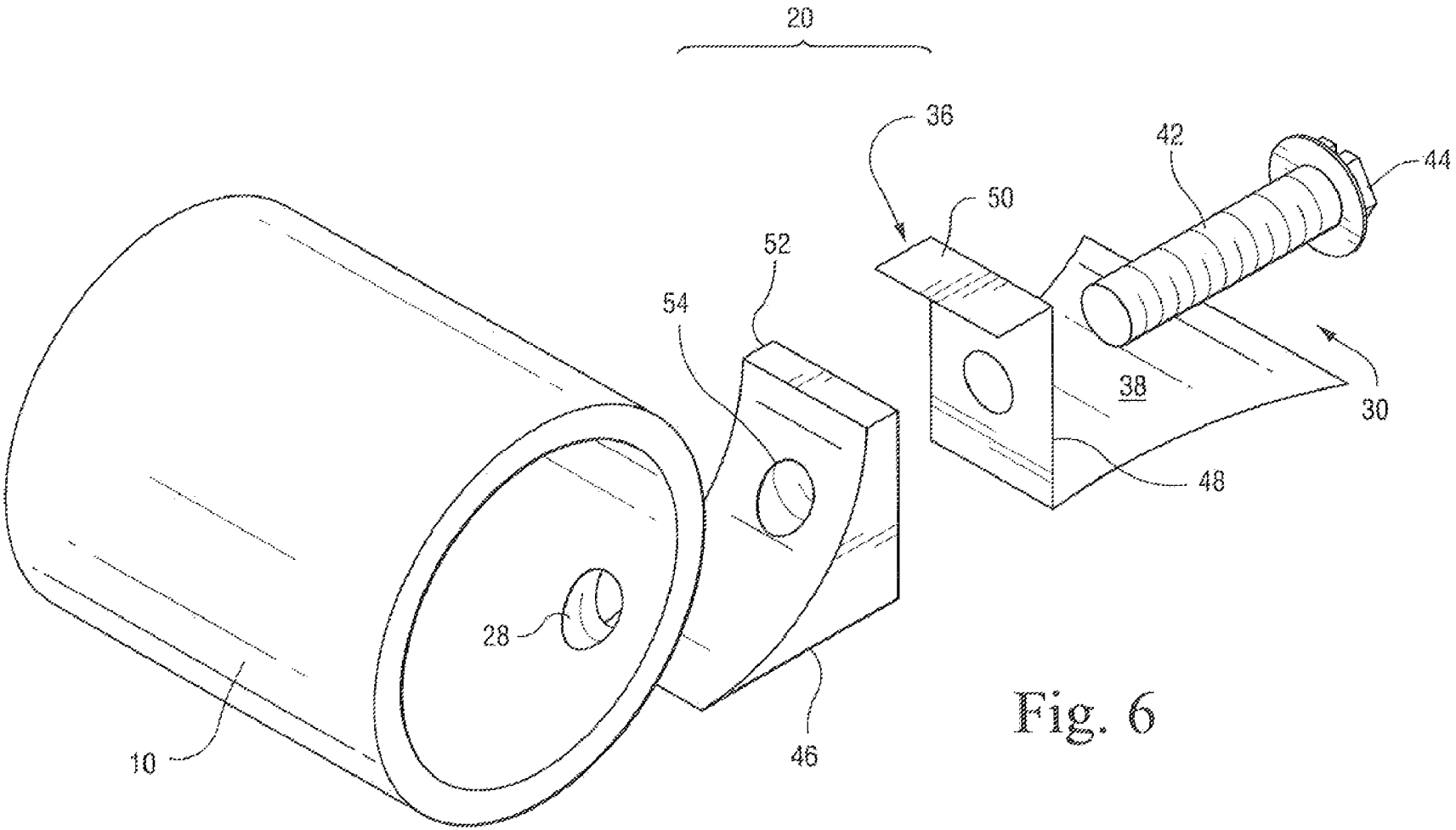
FIG. 6 is an exploded isometric view of the nozzle assembly and a portion of the pipe.

FIG. 6 is an exploded view of the pipe 10 and a nozzle assembly 20. A nozzle-fastener 30 is inserted through an opening in the mounting section 48 of the lip 36 and an opening 54 in the mounting block 46. The stem 42 of the nozzle-fastener screws into a threaded aperture 28 of the pipe to secure the mounting block to the pipe and the lip to the mounting block. The corner 50 of the lip fits around an edge of the mounting block to prevent rotation of the lip.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle assembly for spraying a wash liquid towards a pulp mat, the assembly comprising:

an integral fastener-nozzle having a conduit for the wash liquid, an outlet to the conduit for discharging the wash liquid and an attachment to secure the fastener-nozzle to an aperture in a wash liquid pipe having a curved surface where the attachment seats on the pipe;

a wash liquid direction device extending outwardly from the pipe and adapted to direct the wash liquid from the outlet towards the pulp mat, and the attachment includes a mounting block between the pipe and wash liquid direction device, wherein the mounting block includes a first side curved to seat on the curved surface of the wash liquid pipe, a planar second side opposite to the first side, and an edge of the second side, wherein a planar portion of the wash liquid direction device seats on the second side of the mounting block and a corner of the wash liquid direction device seats over the edge of the second side and extends to a third side of the block, wherein the third side extends between the first side and the second side.

2. A nozzle assembly as in claim 1 wherein the fastener-nozzle includes a threaded outer surface adapted to engage a threaded inner surface of the aperture in the wash liquid pipe.

3. A nozzle assembly as in claim 1 wherein in the fastener-nozzle the attachment and conduit are coaxial.

4. A nozzle assembly as in claim 1 wherein the conduit is in fluid communication with the wash liquid in the pipe.

5. A nozzle assembly as in claim 1 wherein the outlet of the conduit comprises a nozzle for the wash liquid.

6. A nozzle assembly as in claim 1 wherein the fastener-nozzle comprises a hollow stem and the conduit is an internal conduit through the hollow stem.

7. A nozzle assembly as in claim 1 wherein the fastener-nozzle comprises a head on a hollow stem, wherein the head secures the wash liquid direction device to the fastener-nozzle and the conduit is an interior conduit of the hollow stem.

8. A nozzle assembly as in claim 1 wherein the mounting block includes an offset aperture to receive the fastener-nozzle, wherein the offset aperture is offset from a center of the mounting block and a thickness of the mounting block at the aperture is smaller than the thickness at the center of the mounting block.

9. A nozzle assembly as in claim 1 wherein the wash liquid direction device comprises a lip including a curved fan-shaped surface extending from the outlet of the fastener-nozzle towards the mat.

10. An assembly for spraying a wash liquid onto a pulp mat comprising:

a wash liquid pipe extending substantially parallel to the pulp mat and separated by a distance from the pulp mat, wherein the pipe includes a plurality of apertures for discharging wash liquid flowing through the pipe;

a plurality of fasteners nozzle arranged along the wash liquid pipe and adapted to direct wash liquid towards the pulp mat;

wherein the fasteners nozzle each comprise a hollow stem adapted to be inserted into one of said apertures in the pipe;

a wash liquid direction device extending outwardly from the pipe and adapted to direct the wash liquid from the outlet towards the pulp mat, wherein each wash liquid direction device is secured to the pipe by at least one of said fasteners nozzles, and a mounting block between the pipe and wash liquid direction device, wherein the mounting block includes an offset aperture to receive the stem of the fastener-nozzle, wherein the offset aperture is offset from a center of the mounting block and a thickness of the block at the aperture is smaller than the thickness at the center of the mounting block and wherein the mounting block further includes a first side curved to seat on a curved surface of the wash liquid pipe, a planar second side opposite to the first side, and an edge of the second side, wherein a planar portion of the wash liquid direction device seats on the second side of the mounting block and a corner of the wash liquid direction device seats over the edge of the second side and extends to a third side of the mounting block, wherein the third side extends between the first side.

11. An assembly as in claim 10 wherein the fasteners-nozzle are arranged along at least one row parallel to an axis of the pipe.

12. An assembly as in claim 10 wherein the fasteners-nozzle are arranged along the pipe in at least a first row and a second row, and the fasteners nozzle in the first row are staggered with respect to the fasteners nozzle in the second row.

13. An assembly as in claim 10 wherein the stem of each fasteners-nozzle is threaded and engages a threaded surface of the corresponding aperture of the pipe.

14. An assembly as in claim 10 wherein the fastener-nozzles each comprise a head on a hollow stem, wherein the head secures the wash liquid direction device to the fastener-nozzle and the conduit is an interior conduit of the hollow stem.

15. An assembly as in claim 10 wherein the mounting block includes an outside face and an edge of the outside face, and wherein the wash liquid direction device includes a mounting section which seats on the outside face of the block and a corner that fits around the edge of the outside face.

16. An assembly as in claim 10 wherein the wash liquid direction device comprises a lip including a curved fan-shaped surface extending from the outlet of one of the fastener-nozzles towards the mat.

* * * * *